US005864286A

United States Patent [19]

Right et al.

[11] Patent Number: 5,864,286

[45] Date of Patent: Jan. 26, 1999

[54] DISTRIBUTED INTELLIGENCE ALARM SYSTEM HAVING A TWO-TIER MONITORING PROCESS FOR DETECTING ALARM CONDITIONS

[75] Inventors: Robert W. Right, Huntington; Brian M. Morris, Wallingford, both of Conn.; Douglas Price, Ontario, Canada

[73] Assignee: General Signal Corporation, Stamford, Conn.

[21] Appl. No.: 441,833

[22] Filed: May 16, 1995

[51] Int. Cl.[6] ..... G08B 23/00

[52] U.S. Cl. ..... 340/501; 340/506; 340/511; 340/514; 340/517; 340/521; 340/522; 340/588; 340/589; 364/138; 364/139

[58] Field of Search ..... 340/505, 506, 340/508, 511, 514, 517, 521, 522, 588, 589; 364/138, 139

[56] References Cited

U.S. PATENT DOCUMENTS

| | | | |
|---|---|---|---|
| 4,290,055 | 9/1981 | Furney et al. | 340/518 |
| 4,525,700 | 6/1985 | Kimura et al. | 340/518 |
| 4,749,987 | 6/1988 | Ishii | 340/587 |
| 4,901,316 | 2/1990 | Igarashi et al. | 371/37.1 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |
| 5,471,194 | 11/1995 | Guscott | 340/511 |

FOREIGN PATENT DOCUMENTS

| | | |
|---|---|---|
| 485 878 A2 | 5/1992 | European Pat. Off. . |
| 3 128 777 A1 | 2/1983 | Germany . |
| 3 128 788 A1 | 2/1983 | Germany . |
| 3 128 796 A1 | 2/1983 | Germany . |
| 3 128 811 A1 | 2/1983 | Germany . |
| 3 415 819 A1 | 10/1985 | Germany . |
| 4 027 656 A1 | 3/1992 | Germany . |

*Primary Examiner*—Jeffery Hofsass
*Assistant Examiner*—Daryl C. Pope
*Attorney, Agent, or Firm*—Ohlandt, Greeley, Ruggiero & Perle

[57] ABSTRACT

There is provided an alarm system for detecting and warning of the presence of alarm and trouble conditions in a plurality of zones. The system comprises a control panel having a central processing unit and a plurality of alarm devices, each having a microprocessor, that are electrically coupled to the control panel. In particular, the present invention is a two-tier monitoring system such that each alarm device monitors its zone for a shorter rolling time period and the control panel monitors the same zone of the alarm device for a longer rolling time period. An electronic circuit of the alarm device, including the microprocessor, reads and processes data received from various sensors of the alarm device. Periodically, the alarm device updates a first reference value stored in its memory based on the data received from the sensors during the shorter rolling time period. At the same time, the control panel stores a second reference value in its memory that is based on data received during the longer rolling time period and periodically updates that similar reference value. Accordingly, the two-tier monitoring system of the present invention provides for the distribution of tasks between the control panel and at least one alarm device coupled thereto.

27 Claims, 10 Drawing Sheets

FROM FIG.4C

+VBINT
IC
P0
P1
20
P6
P7
AVDD
AN
AV
RESET
X
P2
P3
P4
P5
P8
P9
P10
XT
+VBOP
R30
4
Q1
3
1
2
C8
C9
TO FIG.4D
R41

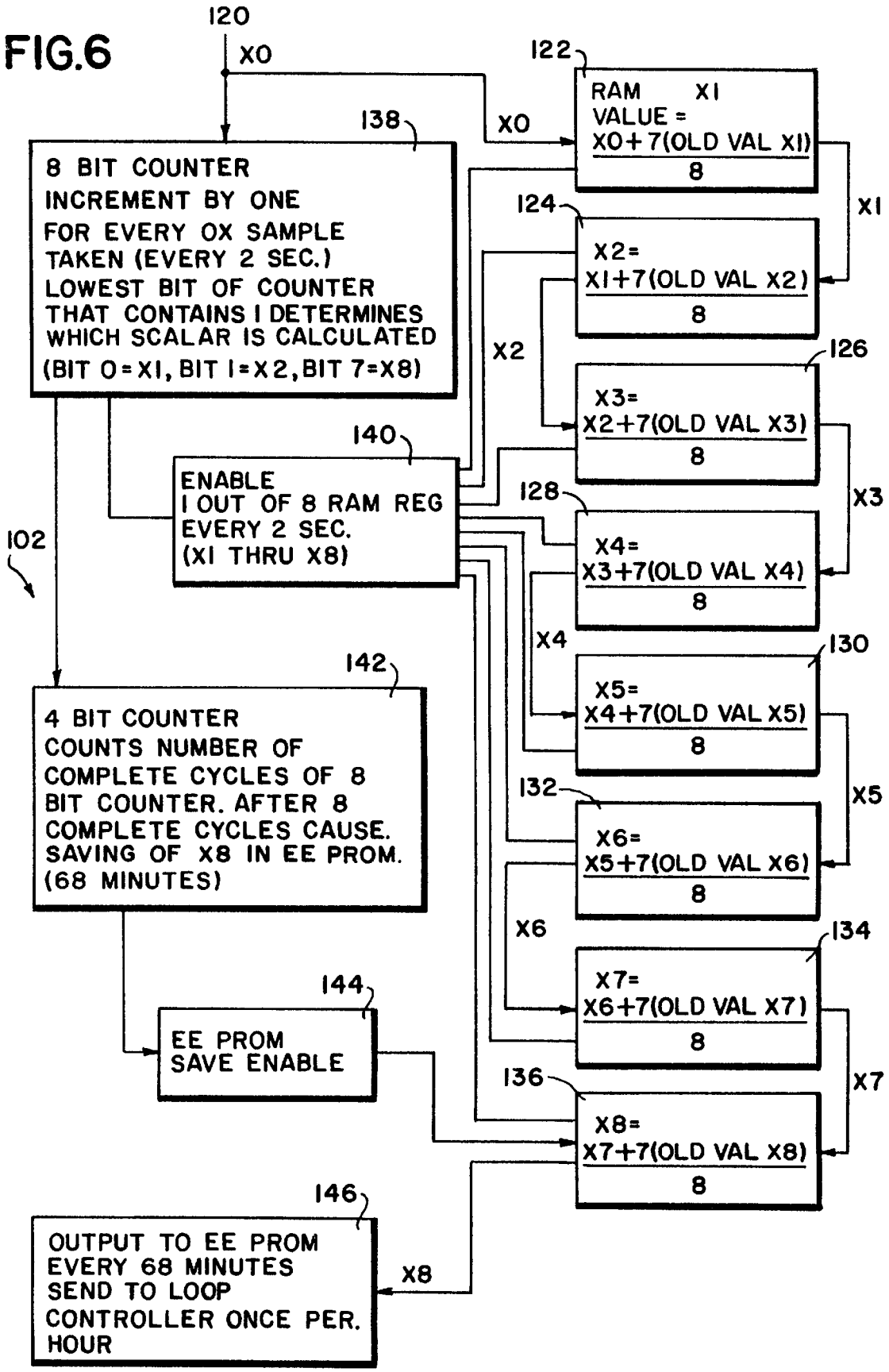
FIG.6
120
X0
122
RAM X1
VALUE =
X0+7(OLD VAL X1)
8
138
8 BIT COUNTER
INCREMENT BY ONE
FOR EVERY OX SAMPLE
TAKEN (EVERY 2 SEC.)
LOWEST BIT OF COUNTER
THAT CONTAINS I DETERMINES
WHICH SCALAR IS CALCULATED
(BIT 0=X1, BIT 1=X2, BIT 7=X8)
124
X2=
X1+7(OLD VAL X2)
8
X1
X2
126
X3=
X2+7(OLD VAL X3)
8
140
ENABLE
I OUT OF 8 RAM REG
EVERY 2 SEC.
(X1 THRU X8)
128
X4=
X3+7(OLD VAL X4)
8
X3
102
X4
130
X5=
X4+7(OLD VAL X5)
8
142
4 BIT COUNTER
COUNTS NUMBER OF
COMPLETE CYCLES OF 8
BIT COUNTER. AFTER 8
COMPLETE CYCLES CAUSE.
SAVING OF X8 IN EE PROM.
(68 MINUTES)
132
X6=
X5+7(OLD VAL X6)
8
X5
X6
134
X7=
X6+7(OLD VAL X7)
8
144
EE PROM
SAVE ENABLE
136
X8=
X7+7(OLD VAL X8)
8
X7
146
OUTPUT TO EE PROM
EVERY 68 MINUTES
SEND TO LOOP
CONTROLLER ONCE PER.
HOUR
X8

DISTRIBUTED INTELLIGENCE ALARM SYSTEM HAVING A TWO- TIER MONITORING PROCESS FOR DETECTING ALARM CONDITIONS

The present invention relates to intelligent detectors, i.e., microprocessor-controlled detectors, that are used within an alarm system for the detection and indication of fire-related emergency conditions. Generally, an alarm system comprises a loop controller or control panel that controls a loop of devices, such as universal modules, smoke and heat detectors and the like, in which the intelligent detector of the present invention is one example of such device. More particularly, the present invention relates to an intelligent detector of an alarm system having a two-tier monitoring process for distributing the task of detecting alarm conditions between the control panel and the various devices that it controls.

The present invention provided in this application is related to inventions described in five other applications with reference to a similar fire alarm and detection system: U.S. patent application Ser. No. 08/441,792 filed on May 16, 1995 entitled Field Programmable Module Personalities (Docket No. 100.0600USU); U.S. patent application Ser. No. 08/441,811 filed on May 16, 1995 entitled Ground Fault Detection With Location Identification (Docket No. 100.0601USU); U.S. patent application Ser. No. 08/441,754 filed on May 16, 1995 entitled Line Monitor For 2-Wire Data Transmission (Docket No. 100.0602USU); U.S. patent application Ser. No. 08/441,803 filed on May 16, 1995 entitled Standalone-mode For Alarm-type Module (Docket No. 100.0603USU); and U.S. patent application Ser. No. 08/441,762 filed on May 16, 1995 entitled Loadshed Method Scheme for Two Wire Data Transmission (Docket No. 100.0604USU). All five of the above applications are owned by the assignee of the present invention.

BACKGROUND OF THE INVENTION

The present invention is in the field of alarm systems. Examples of prior systems of this general type may be appreciated by reference to following U.S. patents: U.S. Pat. No. 4,568,919 to J. Muggli, et al., which issued on Feb. 4, 1986; U.S. Pat. No. 4,752,698 to A. Furuyama, et al., which issued on Jun. 21, 1988; U.S. Pat. No. 4,850,018 to W. R. Vogt, which issued on Jul. 18, 1989; U.S. Pat. No. 4,954,809 to R. W. Right, et al., which issued on Sep. 4, 1990; U.S. Pat. No. 4,962,368 to J. J. Dobrzanski, et al, which issued on Oct. 9, 1990.

The above cited U.S. patents describe systems having control panels that initiate the determination of the states of the units at the various zones or stations in the system by the use of a repetitive polling scheme for polling the detector units or stations from the control panels. In particular, addresses are sent successively on the loop or lines to determine which, if any, units are in an alarm state. Provision is also made in most of these systems to detect trouble conditions in the system.

Many prior art patents describe central control panels having improved intelligence for communication with a plurality of satellite devices. Examples are provided in U.S. Pat. No. 4,901,316 to A. Igarashi, et al., which issued on Feb. 13, 1990; U.S. Pat. No. 5,017,905 to S. Yuchi, which issued on May 12, 1991; and U.S. Pat. No. 5,117,219 to L. D. Tice, et al., which issued on May 26, 1992.

It is also known that the satellite devices themselves may have improved intelligence to perform calculations to determine the likelihood of an alarm related condition. For example, U.S. Pat. No. 5,267,180 to Y. Okayama, which issued on Nov. 30, 1993, entitled FIRE ALARM SYSTEM HAVING PRESTORED FIRE LIKELIHOOD RATIO FUNCTIONS FOR RESPECTIVE FIRE RELATED PHENOMENA provides a system having a plurality of fire detectors connected to a fire receiver for detecting a temperature level, smoke density or gas concentration of a particular surveillance area or zone. Collected information or data inclusive of environmental data of fire related conditions are applied to a respective fire likelihood ratio function and processed by the system in order to improve the accuracy of decision making with respect to fire conditions.

Thus, as provided in the above U.S. patents, complex decisions for alarm systems are determined by one of the components of the system, i.e., either the control panel or the individual satellite devices. Such complex decisions includes calculating a baseline value or analog reference value for each satellite device that characterizes a normal condition for that device. These analog reference values enable the alarm system to compensate for differing environmental conditions within the alarm system's zones of coverage. For example, if a first smoke detector is installed in a normally high temperature zone and a second smoke detector is installed at normally room temperature zone, the reference value of the first smoke detector would be different from the reference value of the second smoke detector in order to compensate for the environmental difference. By continually adjusting the reference value for each smoke detector, optimal system performance is maintained throughout the system.

A significant difference between a present condition of a zone relative to its past condition, indicated by the continually calculated reference value, would indicate a significant change in the environmental conditions, and thus a possible alarm condition, within that zone. The basis of the reference value is variable and dependent upon the detection requirements for the alarm system. For detecting fast developing fires, the reference value may be based on a range of raw data that is collected over a relatively short period of time. In contrast, for detecting slow developing fires, such as a smoldering fire, the reference value must be based on a broader range of raw data that is collected over a much longer period of time. Generally, 24 hours of inertia for collected raw data is required to negate the dilution effections of an extremely slow developing fire.

As stated above, these complex decisions are determined by an existing alarm system in either the control panel or the individual satellite devices that are connected to the control panel. However, both methods have economic and technical drawbacks.

A central control panel or loop controller can determine an alarm condition by continually compiling a running average for each individual sensor. Such control panels have large capacities of memory to store raw data received from the sensors, and thus keep a file history of such data, and powerful Central Processing Units or CPUs to process the raw data. The sensors for such existing systems do not store data in memory or process such data but simply supply the central control panel with the necessary raw data to makes alarm-related decisions.

Central control panels that have large capacities of memory and powerful CPUs require large amounts of continuous loop traffic with each satellite device. Such central control panels must keep track of all raw data collected from each of its satellite devices over a 24 hour period in order to detect extremely slow developing fires. For example, for a control panel that polls each detector every 4 seconds, about 21,600 data samples per device would be necessary in order for the control panel to adequately make alarm reference condition determinations within a given 24 hour period. Accordingly, expensive new communication hardware must be installed, as well as new communication lines that can handle the increased amount of loop traffic; moreover, shielding of the wiring for lower RFI emissions become necessary. In addition, this approach significantly reduces alarm response time since housekeeping chores, such as data quality evaluation and supervision, must be performed by the CPU along with all other tasks.

Similarly, a satellite device can detect a temperature level, smoke density or gas concentration of a particular zone by continually compiling a running average for each individual sensor, such as the device provided in U.S. Pat. No. 5,267,180 to Y. Okayama above. Such device would do all alarm related calculation, including an alarm condition determination, without assistance from the central control panel. Likewise, the control panel would identify an alarm condition only by receiving such an indication from one of its satellite devices. However, in order to make adequate determinations for extremely slow developing fires, as described above, each device requires large capacities of memory and powerful local microprocessors that can be expensive and have large power requirements. Without such capabilities, the precision of alarm condition determinations would be sacrificed for existing alarm systems.

Accordingly, there is a need for an improved alarm system that overcomes the economic and technical drawbacks of existing alarm systems as described above. In particular, there is a need for a alarm system that combines the best advantages of both intelligent control panels and intelligent satellite devices. Therefore, the present invention distributes the various tasks that require substantial intelligence, including the alarm condition detection described above, to the central control panel and satellite devices as well as other devices of the alarm system. This distributed intelligence configuration of the present invention does not require special communication devices and wiring; moreover, it provides optimal performance for certain capabilities, such as detecting extremely slow developing fires.

By relocating or distributing many of the processing tasks from the control panel to the detector, the amount of traffic which must travel between the control panel and each detector is considerably reduced. The advantages of distributing the tasks is that a lower communication rate may be used throughout the entire system. Also, the signal-to-noise ratio, error reduction, and system reliability are improved. Another advantage to a lower communication rate is that special wiring is not required between the control panel and the detectors.

Against the foregoing background, it is a primary object of the present invention to provide an alarm system for detecting and warning of the presence of alarm and trouble conditions in a plurality of zones that distributes various system tasks, such as determining an alarm condition, throughout the system.

It is another object of the present invention to provide a two-tier alarm system in which the various system tasks are handled on a grand scale by a control panel in conjunction with a plurality of intelligent detectors, and on smaller scales by the individual intelligent detectors alone.

It is a further object of the present invention to provide such a two-tier alarm system in which the control panel determines whether an alarm condition exists, particularly for slow developing fires such as smoldering fires.

It is still further object of the present invention to provide such a two-tier alarm system in which the intelligent detector determines whether an alarm condition exists, particularly for fast developing fires.

It is still another object of the present invention to provide a two-tier alarm system for a distributed intelligence system that includes a control panel having processing capabilities that are redundant with functions normally executed by individual detectors. The control panel makes use of such redundant processing capabilities when an operation failure of a detector occurs.

SUMMARY OF THE INVENTION

A primary feature of the present invention to economically and technically provide a two-tier, cooperating system for detecting alarm conditions by both a control panel and a plurality of individual intelligent detectors connected to the control panel. The control panel (and similarly each of the intelligent detectors) utilizes a stable analog reference value that is a baseline function of a normal condition or state in each zone covered by the alarm system. Within each zone, an alarm condition is detected in two ways. One ways is for each detector to calculate and store a first reference value for its respective zone and monitor the deviation of environmental conditions within the zone relative to the first reference value. The other way is for the control panel to calculate and store a second reference value for the zone and monitor the deviation of environmental conditions in the zone relative to the second reference value.

To accomplish the foregoing objects and advantages, the present invention, in brief summary, is a two-tier alarm system for detecting and warning of the presence of various alarm conditions within a particular zone of a plurality of zones comprising at least one detector, a plurality of communication lines and a control panel. The detector is located within the particular zone and includes at least one sensor for measuring an environmental condition in the particular zone and generating raw data corresponding to measurements of the environmental condition, means for calculating a first reference value based on the raw data received from the at least one sensor and generating a series of the first reference values based on periodic measurements of the raw data and means for determining whether an alarm condition exists based on the first reference value. The plurality of communication lines extend from the detector for receiving and transmitting the series of first reference value from the detector. The control panel is connected to the plurality of communications lines and includes means for receiving the series of the first reference value from the plurality of communications lines, means calculating a second reference value based on the series of the first reference values and means for determining whether the alarm condition exists based on the second reference value.

BRIEF DESCRIPTION OF THE DRAWINGS

The foregoing and still further the objects and advantages of the present invention will be more apparent from the following detailed explanation of the preferred embodiments of the invention in connection with the accompanying drawings:

FIG. 6 is a flow diagram corresponding to block 102 of FIG. 5.

DETAILED DESCRIPTION OF THE PREFERRED EMBODIMENT

Figure 1:
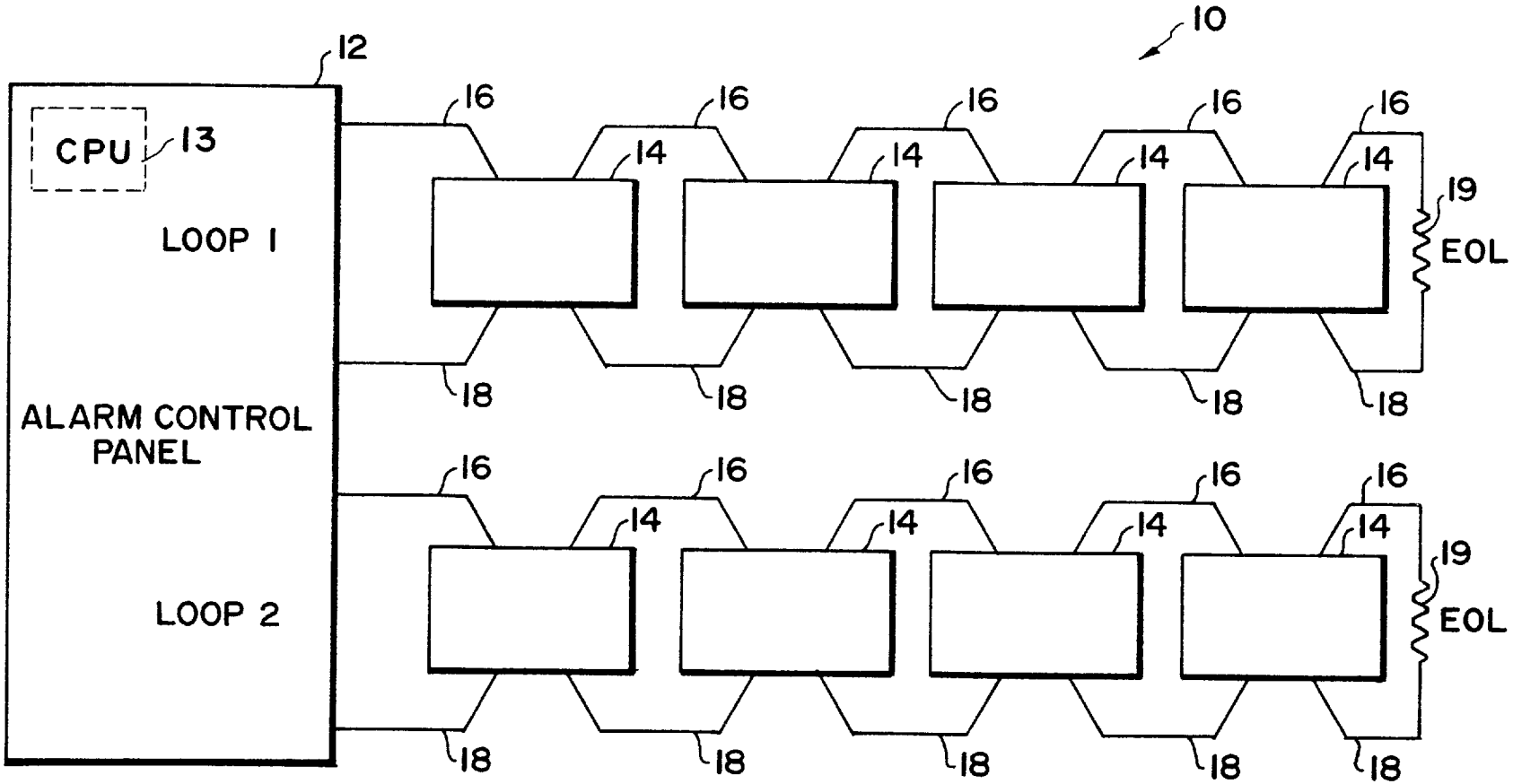
FIG. 1 is a block diagram of the alarm system of the preferred embodiment in accordance with the present invention.

Referring to the drawings and, in particular, to FIG. 1, there is provided a distributed intelligence alarm system of the preferred embodiment which is generally represented by reference numeral 10. The alarm system 10 includes an alarm control panel 12 and at least one loop of intelligent satellite devices or detectors 14 connected to the control panel. A plurality of communication lines for each loop, namely first lines 16 and second lines 18, connect the detectors 14 to the control panel 12. Preferably, the first lines 16 and the second lines 18 form the primary elements of a two wire multiplex communication loop. As shown in FIG. 1, the preferred embodiment includes two loops of detectors 14, specifically LOOP 1 and LOOP 2, each having an end-of-line or EOL terminator 19 connected to the last detector 14 at the end of each loop.

It is to be understood that a wide variety of different devices may be connected to the control panel 12 along with the detectors 14 and the present invention may utilize a wide variety of different features to determine and analyze an alarm condition. For example, other devices and features are set for in U.S. patent application Ser. No. 08/441,792 filed on May 16, 1995 entitled Field Programmable Module Personalities (Docket No. 100.0600USU); U.S. patent application Ser. No. 08/441,811 filed on May 16, 1995 entitled Ground Fault Detection With Location Identification (Docket No. 100.0601USU); U.S. patent application Ser. No. 08/441,754 filed on May 16, 1995 entitled Line Monitor For 2-Wire Data Transmission (Docket No. 100.0602USU); U.S. patent application Ser. No. 08/441,803 filed on May 16, 1995 entitled Standalone-mode For Alarm-type Module (Docket No. 100.0603USU); and U.S. patent application Ser. No. 08/441,762 filed on May 16, 1995 entitled Load-shed Method of Power Conservation (Docket No. 100.0604USU). All five of these applications, owned by the assignee of the present invention, were filed on even date and are incorporated herein by reference.

The control panel 12 has at least one processor means, such as a central processing unit or CPU 13 as shown in FIG. 1, that controls the flow of information between the control panel and the detectors 14 via communication lines 16, 18. Any type CPU having the processing power and memory capacity to perform the functions described below may be used for the control panel 12 of the present invention. Among the many features performed by the CPU 13 of the control panel 12, the CPU performs the task of detecting alarm conditions in areas covered by the alarm system 10. For the purposes of the present invention, an alarm condition includes an alarm status, trouble status, active status, or any other indication of a possible alarm condition. The control panel 12 performs the task of detecting alarm conditions in the zones covered by the alarm system 10 in two simultaneous ways. One way is to collect reference values from each of detectors 14 via communication lines 16, 18 and determine whether an alarm condition exists in one of the zones. The other way is to permit the individual detectors 14 to determine whether an alarm condition exists in the zones and to await a signal from one of the detectors that indicates that an alarm condition exists. In this manner, the task of determining an alarm condition is distributed between the control panel 12 and the detectors 14.

Figure 2:
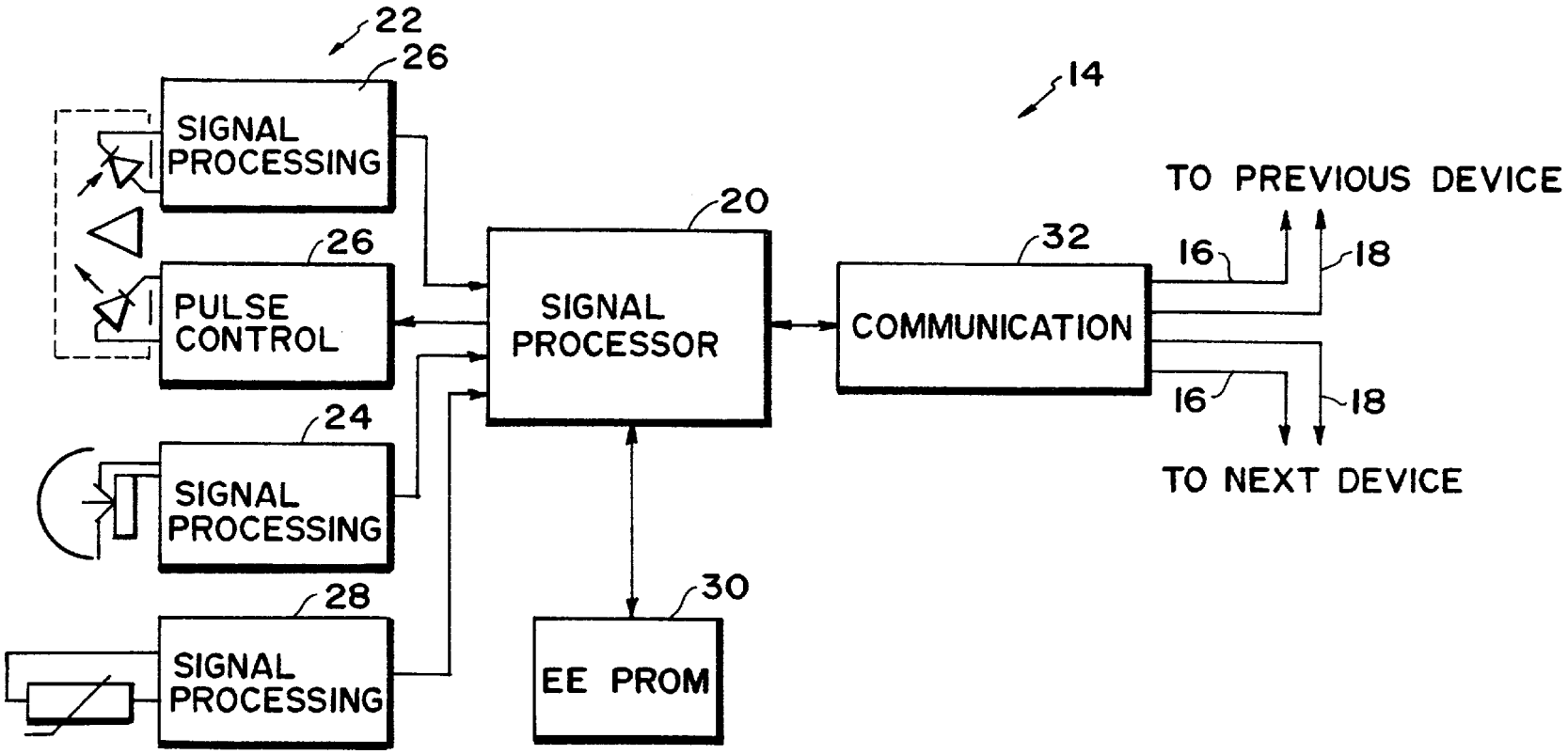
FIG. 2 is a block diagram of one of the intelligent detectors of FIG. 1.

Referring to FIG. 2, each detector 14 has a built-in signal processor 20 that processes raw data received from at least one alarm condition sensing device or sensor 22. The signal processor 20 is programmable to perform the task of determining an alarm condition and report its results to the control panel 12, via a communication circuit 32, as necessary. In addition, the signal processor 20 has internal memory that provides workspace to perform calculations and external memory 30 to store processed information. As shown in FIG. 2, an Electronically Erasable Programmable Read Only Memory (EEPROM) is used as the external memory 30 to store processed information about each detector 14. For the preferred embodiment, the signal processor 20 is a NEC microprocessor, model no. 75028, having 256 bytes of memory and the external memory 30 is an EEPROM manufactured by EXCEL.

The detector 14 includes one or more sensors 22 that collect environmental information about the locality of the detector and produces raw data that corresponds to the environmental information. The detector 14 determines whether an alarm condition exists based on the raw data collected by their sensor or sensors 22. The preferred embodiment is comprised of three independent sensors 22, each looking for a different type of fire condition or signature: an ionization sensor 24, a photoelectric sensor 26 and a temperature sensor 28.

The ionization sensor 24 has an ionization sensing dual chamber for detecting aerosol particles that are less than 0.3 microns in size in the detector's sensing chamber. Particles of this size are sometimes referred to as "invisible products of combustion," which are generated early in a fire's development and prevalent in fast flaming fires. The dual chamber of the ionization sensor 24 is uni-polar design, using 1 $\mu$C of Americium 241 to ionizing the air within the two chambers. A sensing chamber operates in conjunction with a reference chamber that provides course compensation to partially minimize the effects of environmental variables such as humidity, temperature, and barometric pressure. The signal processor 20 of the detector 14 provides additional environmental compensation and fine tuning of the detector's response to sensor activity. An imbalance in the electrical conductivity between the sensing and reference chambers is indicative of activity within the sensing chamber that produces informative raw data for the signal processor 20.

The photoelectric sensor 26 has a photoelectric detection chamber for detecting aerosol particles greater than 0.3 microns in size that are common in smoke. Particles of this size are typically visible to the human eye, and are associated with smoldering fires. The photoelectric detection chamber uses an optical refraction technique at infrared (IR) wavelengths to identify the presence of larger particles within the sensing chamber.

The temperature or heat detecting sensor 28 detects temperatures that are about 65 degrees Fahrenheit (18 degrees Celsius) above ambient room temperature. The temperature sensor 28 is a low mass thermistor, capable of rapid thermal response. By analyzing this information in the detector's signal processor 20, the detector 14 is also capable of detecting a rate of temperature rise which exceeds 15 degrees/minute. The temperature sensor 28 is primarily useful in detecting rapidly growing large fires and fires in which the smoke is not easily detected.

Each sensor 22 uses a differential sensing and compensating process to provide accurate information to the detector's alarm algorithm processor. The detector 14 adjusts each sensors 22 baseline reference to compensate for background environmental conditions such as dust, temperature, pressure and cigarette smoke. The differential sensing and compensating process is independent for each sensor 22 of a particular detector 14. About every one second to about every four seconds, a sensing element's real-time analog value is compared against its reference value, which is stored in the internal memory of the signal processor 20 of the detector 14.

Figure 3:
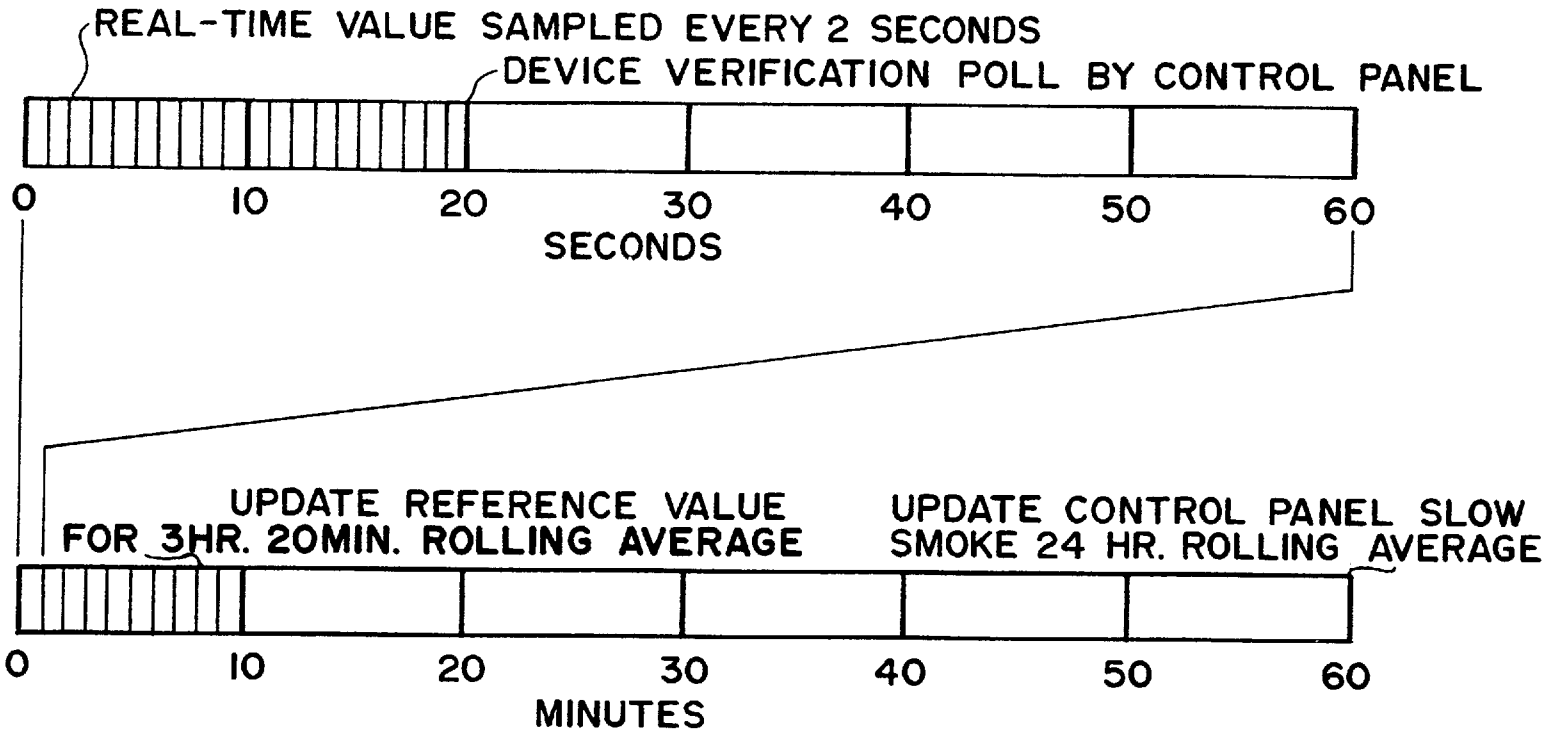
FIG. 3 is a timing diagram of the alarm system of the preferred embodiment in accordance with the present invention.

Referring to FIG. 3, there are shown the major processing steps that occur within the alarm system 10 during its one hour processing cycle. The raw data is read from the sensors 22 and processed by the signal processor 20 of the detector 14 from about every one second to about every four seconds. For the preferred embodiment, the raw data is read about every two seconds. The raw data and processed results are stored in the signal processor's internal memory until the 8th scalar X8 or first reference value is determined by the signal processor. It has been determined that the 8th scalar X8 is ready every sixty-eight minutes and, thus, is transferred from the signal processor 30 to the external memory or EEPROM 20.

Every twenty seconds, the detector 14 must respond to a poll from the control panel 12. The control panel 12 merely inquires as to the status of the detector 14.

As stated above, the 8th scalar X8 is transmitted in the external memory 30 every sixty-eight minutes. Accordingly, the 3 hour and 20 minute rolling average that is stored in the external memory is updated by the 8th scalar X8 every sixty-eight minutes. As shown in FIG. 3, the 8th scalar X8 is updated in the internal memory of the signal processor 20 approximately every 8 minutes. For the preferred embodiment, the external memory 30 stores the first reference value for initialization during power-up of the detector 14 and, thereafter, the external memory merely keeps records of the first reference value whereas the internal memory of the signal processor 20 serves as the primary storage area for the first reference value. In addition, from about every fifteen minutes to about every two hours, the detector 14 updates the 24 hour rolling average and the control panel 12 produces a X12 scalar value or second reference value that is stored in the control panel. For the preferred embodiment, the control panel 12 is updated about every 60 minutes. Additional background processing and housekeeping is performed on an as needed basis.

The control panel 12 uses a process similar to that used by the detectors 14 to independently monitor a detector's alarm criteria. An extremely slow developing smoldering fire could fool the detector's rolling 3 hour 20 minute compensation process. The control panel 12 retains in its CPU memory a second reference value for each detector 14, based on a 24-hour rolling average, updated about every 60 minutes. The second reference value is the 12th scalar or X12 value that is based on the first reference value or 8th scalar (X8) calculated by each detector 14. Also, the raw data of the sensors 22 is collected from the detectors 14 by the control panel 12 at a similar time interval, preferably about once per hour, and compares the raw data to the second reference value. Should the control panel 12 determine that the comparison of the raw data and the second reference value produces a result that exceeds the 24 hour rolling average by a predetermined threshold value, the control panel will initiate a signal that indicates an alarm condition.

Figure 4A:
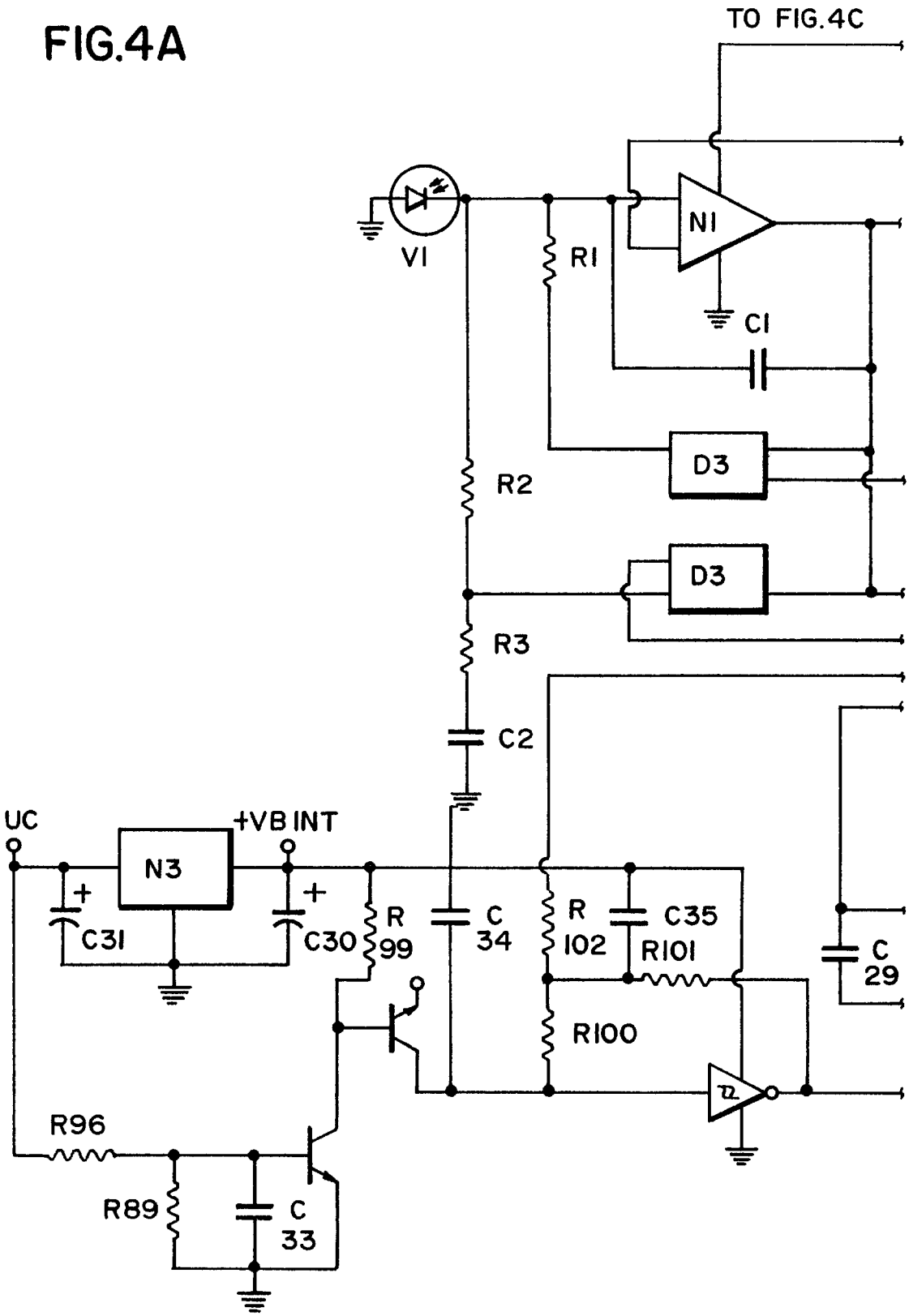
FIGS. 4A through 4E is a schematic diagram of the intelligent detector of FIG. 2.
Figure 4B:
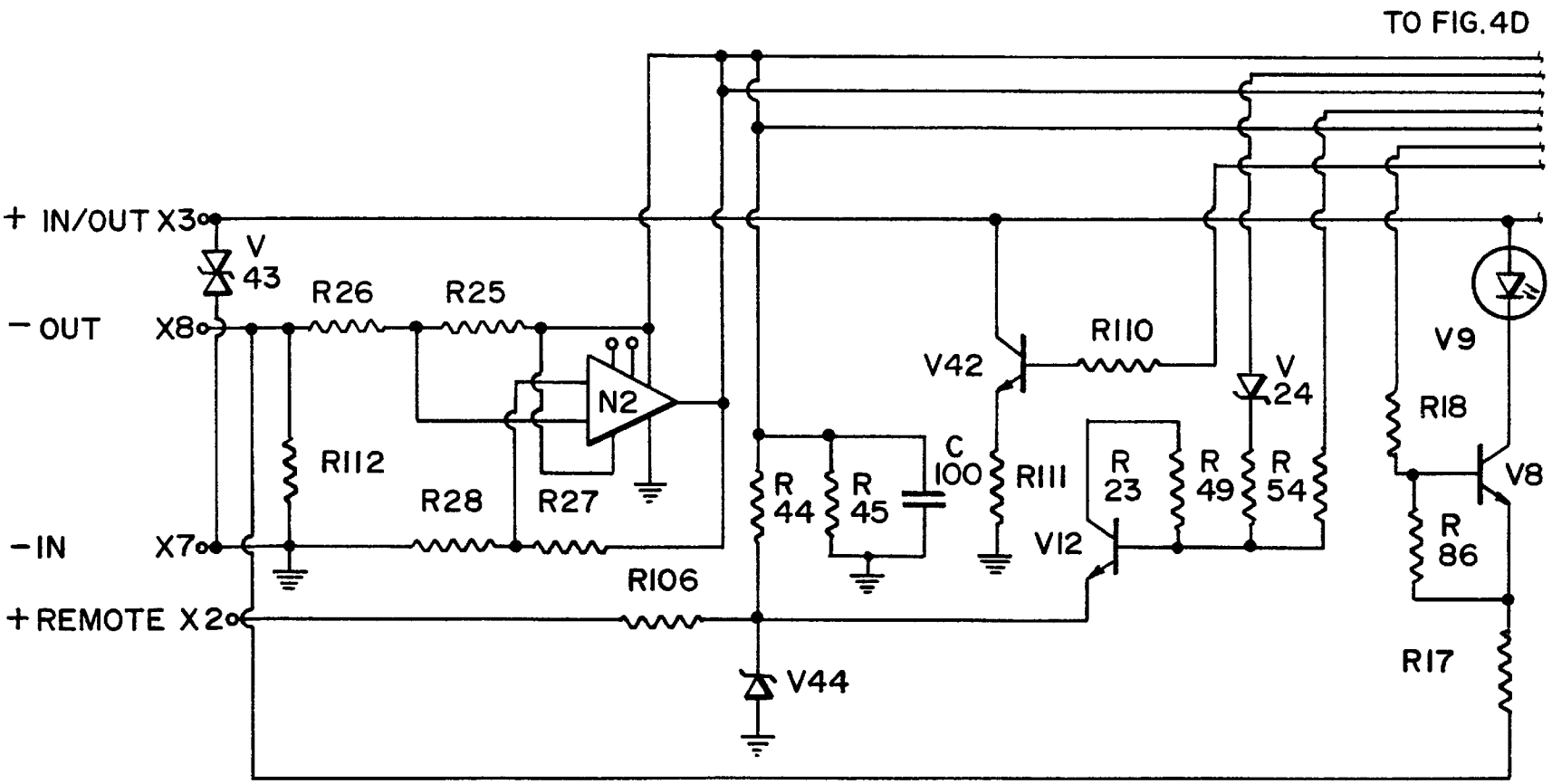
Figure 4C:
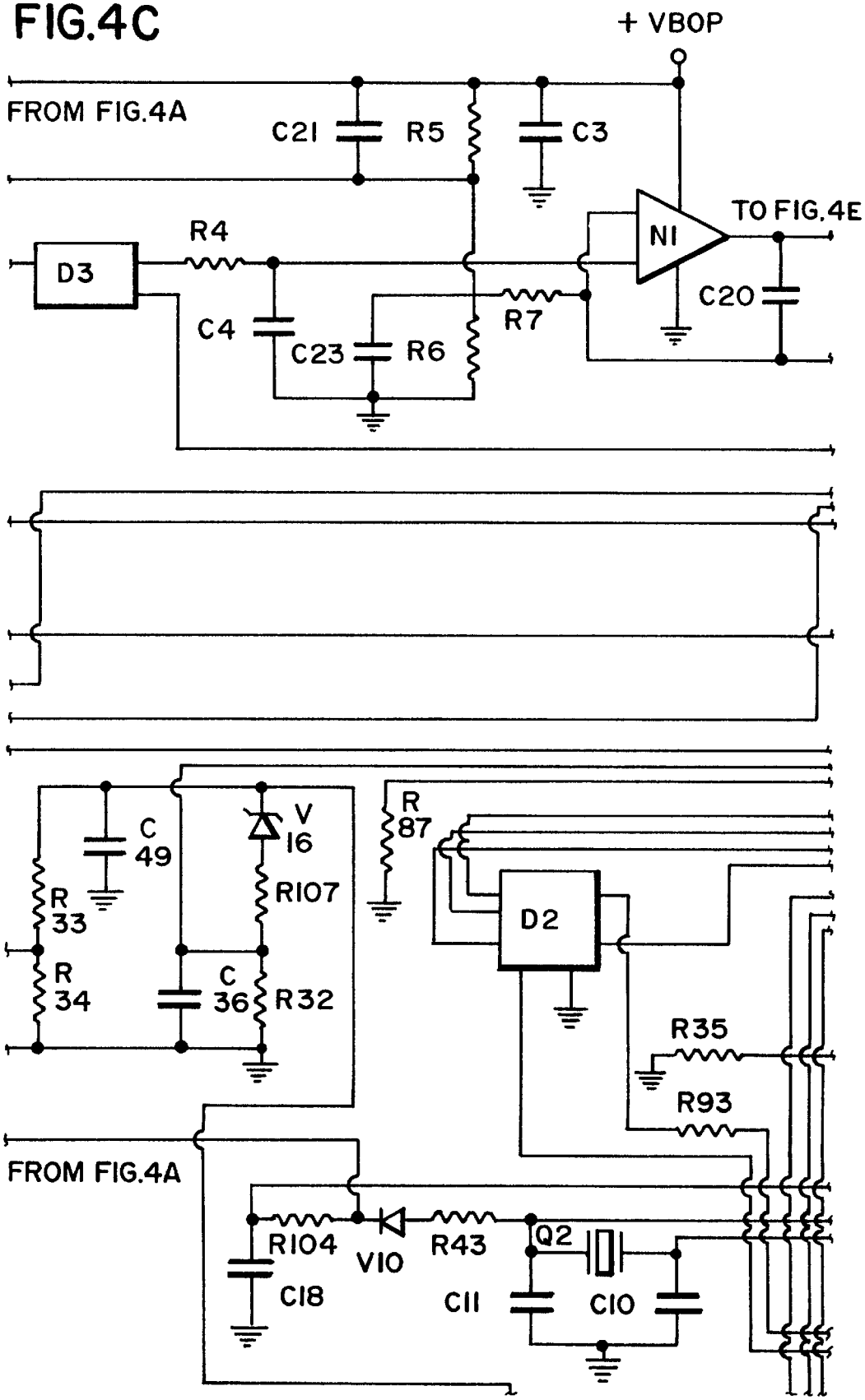
Figure 4D:
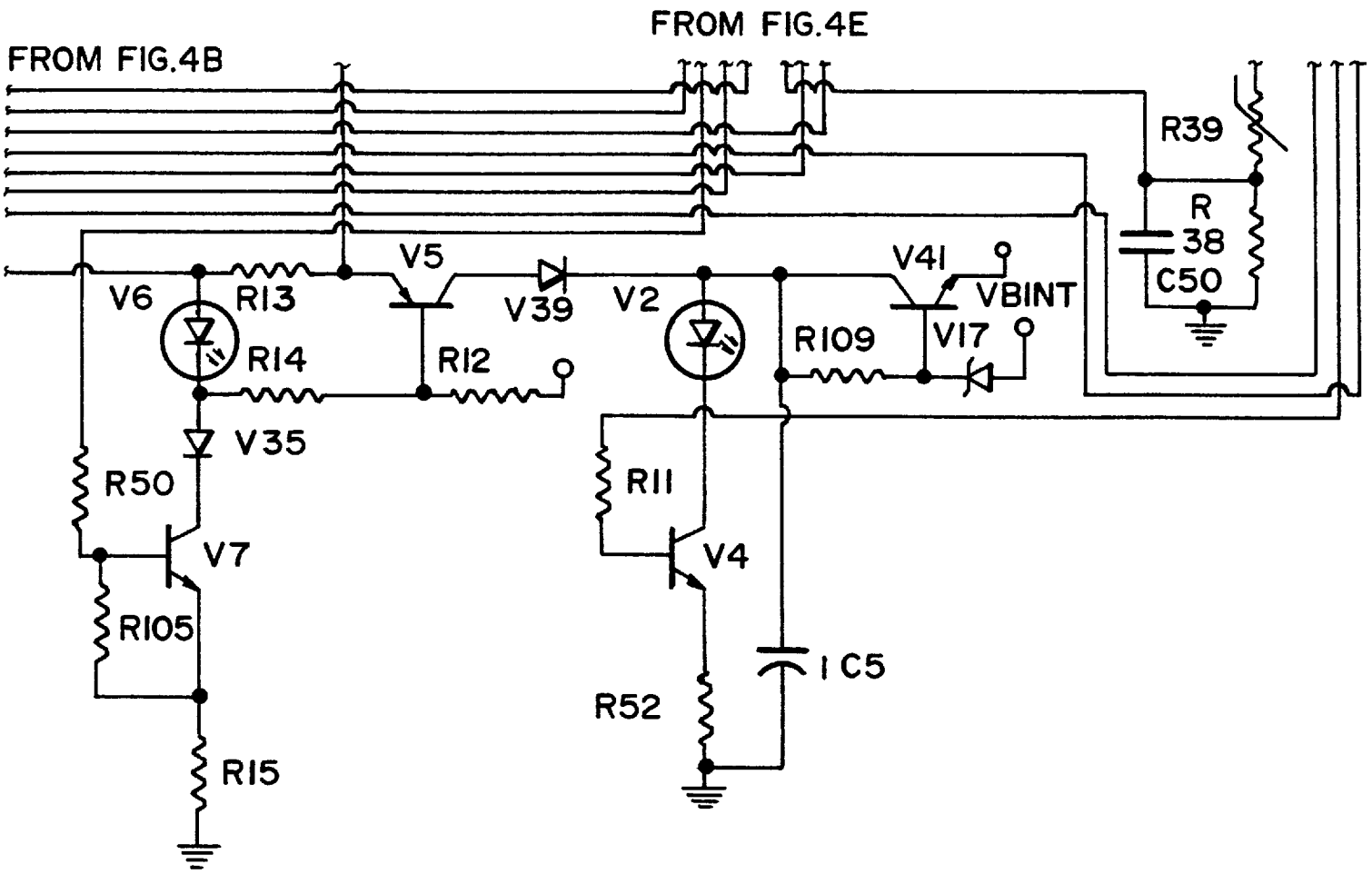
Figure 4E:
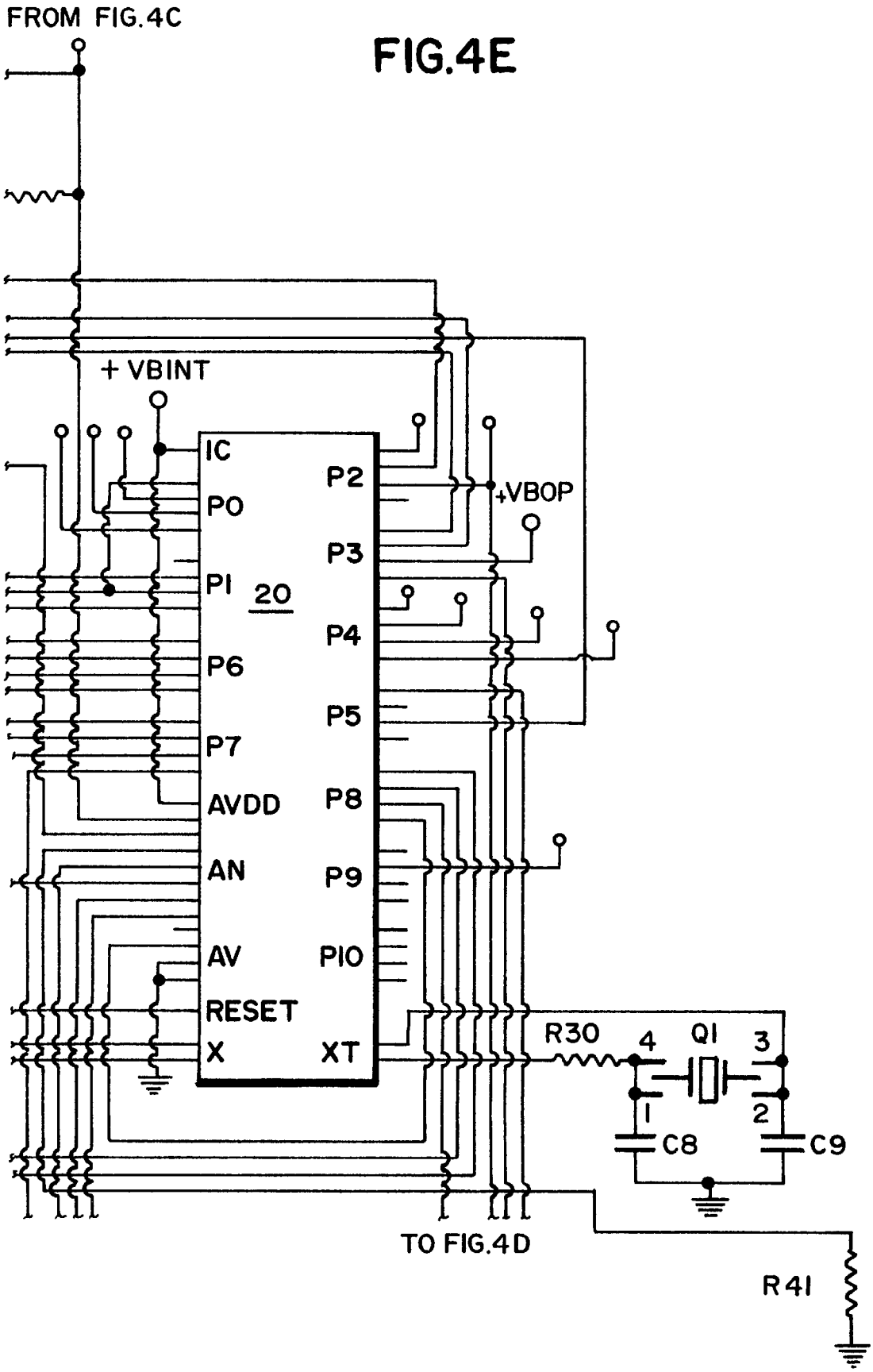

Referring to FIGS. 4A through 4E, there is generally shown a schematic diagram of the detector 14 of FIG. 2. The communications lines 16, 18 that connect the detector to the control panel 12 are shown in FIG. 4B as +IN/OUT, −OUT, −IN and +REMOTE. The external memory or EEPROM 30 connected to the signal processor 20 is shown in FIG. 4C as D2. Also, the various elements of the communication circuit 32 are generally shown in FIGS. 4B and 4D. Further, the signal processor 20 is shown in FIG. 4E as having various pin connections to elements throughout the entire circuit of the detector 14.

Figure 5:
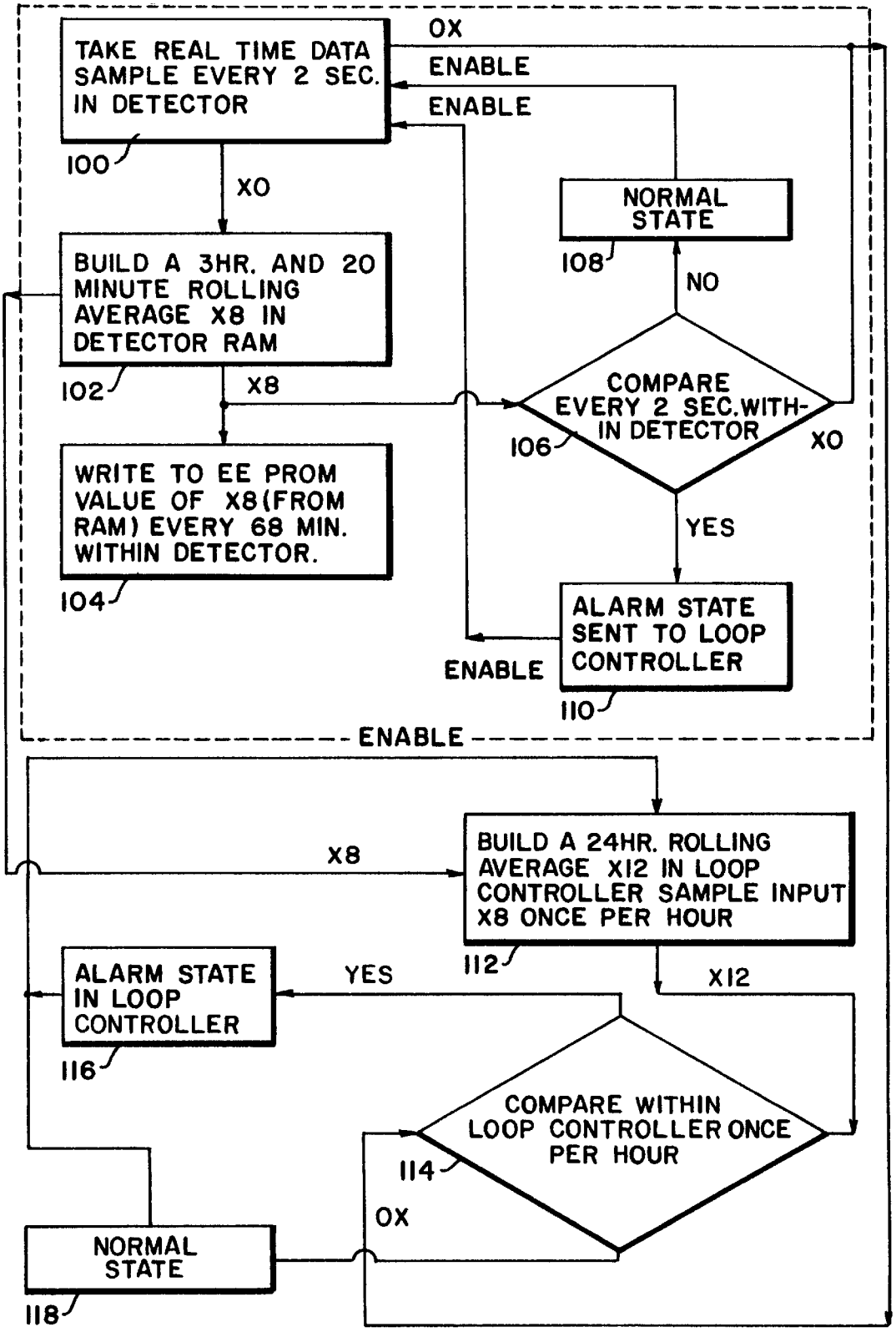
FIG. 5 is a flow diagram of the operation of the alarm system of the preferred embodiment in accordance with the present invention.

Referring to FIG. 5, the alarm system 10 of the present invention follows a continuous loop of process steps for detecting an alarm condition, starting with block 100. As represented by block 100, each detector 14 of the alarm system 10 takes a real time data sample of the absolute input or raw data from its sensors about every one second to about every four seconds, preferably every two seconds. These inputs are averaged locally at the detector 14 using the signal processor 20. As shown in block 102, the data sample is averaged over a 3 hour and 20 minute rolling time period using an 8 step inertial digital filter thereby resulting in an 8th scalar or X8, i.e., a first reference value. X0 is the real time input to block 102, and X8 is the scalar with the largest amount of inertia that is output from block 102.

Referring to FIG. 6, the process represented by block 102 of FIG. 5 is shown in more detail. In particular, FIG. 6 represents an implementation of a precise way of calculating a rolling average, and thus an 8th scalar or first reference value, from a series of real time input using a minimum configuration of hardware. Specifically, the process may be executed on a low power consumption, 4 bit microcontroller having a 256 byte memory capacity. The rolling average calculated by the signal processor 20 of the present invention is not necessarily an arithmetic mean. In fact, it is preferred that the average be weighted and given more import to older data than newer data. It may also give less weight to data changing toward alarm point than away from it. For the preferred embodiment, the function of this process when the series for real time input rises is X n(I)={X n(I−1)+7*X n−1(I)}/8, and the function when the series declines is X n(I)={X n(I−1)+3*X n−1(I)}/4, wherein "n" denotes present value, "(n−1)" denotes previous value, and "(I−1)" denotes the value of the scalar that is one number lower than scalar(I). The new value for the scalar X n(I) equals the current value of the scalar that is one number below the scalar being evaluated plus 7 or 3 times the previous value of the scalar, all divided by 8 or 4 depending on the ascension or declination of the real time value. For example, to calculate X8 for rising real time input, X8={X7+7*(previous value of X8)}/8. Scalars 1 through 8 are maintained in this fashion.

As shown by block 140 in FIG. 6, a series of scalar values, namely scalars 1 through 8, are calculated by the signal processor 20 of the detector 14. In particular, block 122 receives the real time input X0 and produces the first scalar X1. The output X1 of block 122 is fed to the input of block 124 which in turn produces the next or second scalar, X2. Thereafter, successively for blocks 126, 128, 130, 132, 134 and 136, each scalar value is calculated from the previous scalar value. By example, the above blocks, namely blocks 122 through 136, show the function for rising values in FIG. 6 but, as stated above, the function for declining values would be used for these blocks when appropriate.

Also shown in FIG. 6 are blocks 138 and 140 which determine which scalar is calculated at a given moment. An 8 bit counter of the signal processor 20 is incremented by 1 for each real time value X0 that is polled every 2 seconds from the sensors. As indicated by block 138, the lowest bit of the counter that contains logic 1 determines which scalar is currently calculated. Thus, under the control of the counter, 1 of the 8 RAM Registers containing the scalar values is enabled every 2 seconds, as shown by block 140. Further, as shown in block 142, a 4 bit counter of the signal processor 20 counts the number of complete cycles of the 8 bit counter. Following this 4 bit counter, a save operation of the 8th scalar is made to the EEPROM every 68 minutes, as initiated by block 144 and completed through to output point 146.

Referring again to FIG. 5, the 8th scalar or first reference value is loaded into EEPROM from the internal memory of the signal processor 20 every 68 minutes, as shown in block 104. This is the value which is compared to the real time input (X0) on every sample to see if the alarm threshold has been reached, as shown in block 106. The alarm threshold is the delta value of A/D count that represents an advertised level of smoke sensitivity and is stored in EEPROM of the detector 14. If the alarm threshold has not been reached, an normal state is enabled in block 108 and another real time data sample is taken in block 100. If the alarm threshold has been reached, an alarm stated is generated locally and sent to the loop controller 12 as represented by block 110. Thereafter, another real time data sample is taken in block 100.

About every fifteen minutes to about every two hours, as represented by block 112, the control panel recovers the 8th scalar or X8 value, i.e., first reference value, from the EEPROM of each detector 14 and averages them for each device using a process similar to the one shown in FIG. 6. It is preferred that the control panel receives the 8th scalar or X8 value about every hour. A new X12 scalar or second reference value is then maintained in the control panel. At this time, the real time input X0 is sampled by the control panel and compared to X12 in the control panel, as shown in block 114. If the real time input X0 and the second reference value X12 differ by a particular threshold amount currently stored in the CPU of the control panel, an alarm state will be active as shown by block 116. Otherwise, where the particular threshold amount has not been reach, the control panel will remain in a normal state, as shown by block 118.

The invention having been thus described with particular reference to the preferred forms thereof, it will be obvious that various changes and modifications may be made therein without departing from the spirit and scope of the invention as defined in the appended claims.

Wherefore, we claim:

1. A two-tier alarm system for detecting and warning of the presence of various alarm conditions within a particular zone of a plurality of zones comprising:

a detector, located within said particular zone, including (1) at least one sensor for measuring an environmental condition in said particular zone and generating raw data corresponding to measurements of said environmental conditions, (2) means for calculating a first reference value based on said raw data received from said at least one sensor and generating a series of said first reference values based on periodic measurements of said raw data and (3) means for determining whether an alarm condition exists based on said first reference value;

a plurality of communication lines extending from said detector for receiving and transmitting said series of first reference values from said detector; and a control panel, connected to said plurality of communication lines, including (1) means for receiving said series of said first reference value from said plurality of communication lines; (2) means for calculating a second reference value based on said series of said first reference values and (3) means for determining whether said alarm condition exists based on said second reference value, wherein transmission of said raw data along said plurality of communication lines to said control panel and processing of said raw data by said control panel is minimized.

2. The two-tier alarm system of claim 1, wherein said control panel includes means for sampling said raw data, wherein said control panel samples said raw data at a substantially less frequent time interval than said means for calculating of said detector.

3. The two-tier alarm system of claim 2, wherein said means for calculating of said detector receives said raw data from about every 1 second to about every 4 seconds whereas said control panel samples said raw data from about every 15 minutes to about every 2 hours.

4. The two-tier alarm system of claim 1, wherein said means for determining of said detector includes means for comparing said raw data with said first reference value.

5. The two-tier alarm system of claim 1, wherein said means for determining of said control panel includes means for receiving said raw data from said plurality of communications lines and means for comparing said raw data with said second reference value.

6. The two-tier alarm system of claim 1, wherein said means for calculating said first reference value includes means for storing a most-recent range of said raw data in a memory portion of said detector for each of said periodic measurements of said raw data.

7. The two-tier alarm system of claim 6, wherein said means for calculating said first reference value includes means for averaging substantially all values of said most-recent range of said raw data in order to calculate said first reference value.

8. The two-tier alarm system of claim 1, wherein said means for calculating said first reference value is a microcontroller that is coupled to an EEPROM and has an internal memory portion for storing said first reference value.

9. The two-tier alarm system of claim 1, wherein said means for calculating said second reference value includes means for storing a most-recent range of said series of said first reference values in a memory portion of said control panel after receipt of each of said first reference values.

10. The two-tier alarm system of claim 9, wherein said means for calculating said second reference value includes means for weighted averaging all values of said most-recent range of said series of first reference values in order to calculate said second reference value.

11. The two-tier alarm system of claim 1, wherein said at least one sensor is an ion sensor for detecting invisible ion products of combustion in said particular zone.

12. The two-tier alarm system of claim 1, wherein said at least one sensor is a photo sensor for detecting visible photo smoke in said particular zone.

13. The two-tier alarm system of claim 1, wherein said at least one sensor is a temperature sensor for detecting an amount of heat that is present in said particular zone.

14. The two-tier alarm system of claim 1, wherein said detector includes at least two sensors and means for scaling and weighting an output of each sensor so said outputs of said sensors may be combined and processed by said means for calculating said first reference value.

15. The two-tier alarm system of claim 1, wherein said control panel includes means for redundant processing of functions of said means for calculating said first reference value that is responsive to an operation failure of said means for calculating said first reference value.

16. A method for detecting and warning of the presence of various alarm conditions within a particular zone of a plurality of zones for an alarm system that includes a detector, a control panel and a plurality of communication lines connecting the detector to the control panel, the method comprising the steps of:

generating raw data corresponding to environmental measurements of the particular zone;

calculating, within the detector, a first reference value of a series of first reference values based on said raw data;

transmitting said series of first reference values from said detector to the control panel;

calculating, within the control panel, a second reference value based on said series of said first reference values; and determining whether said alarm condition exists based on one of either said first reference value and said second reference value, wherein transmission of said raw data along said plurality of communication lines to said control panel and processing of said raw data by said control panel is minimized.

17. The method of claim 16, further comprising the step of comparing said raw data to said first reference value after calculating said first reference values to determine whether an alarm condition exists.

18. The method of claim 16, wherein said step of transmitting said series of first reference values includes transmitting a sampled portion of said raw data from the detector to the control panel.

19. The method of claim 18, further comprising the step of comparing said sampled portion of said raw data to said second reference value after calculating said second reference value to determine whether an alarm condition exists.

20. The method of claim 16, wherein said step of generating said raw data includes sampling of said raw data periodically by the detector.

21. The method of claim 16, wherein said step of calculating said first reference value includes building a short-term rolling average of said raw data.

22. The method of claim 21, wherein said short-term rolling average is about 3 hours and 20 minutes.

23. The method of claim 22, wherein said step of calculating said first reference value includes storing said short-term rolling average, in increments, in a memory portion of the detector until said first reference value is ready to be transmitted to the control panel.

24. The method of claim 23, wherein said short-term rolling average is stored within the memory portion about every 68 minutes.

25. The method of claim 16, wherein said step of calculating said second reference value includes building a long-term rolling average of said series of said first reference values.

26. The method of claim 25, wherein said long-term rolling average is about 24 hours.

27. A two-tier alarm system for detecting and warning of the presence of various alarm conditions within a particular zone of a plurality of zones comprising:

a detector, located within said particular zone, including (1) at least one sensor for measuring an environmental condition in said particular zone and generating raw data corresponding to measurements of said environmental conditions, (2) means for calculating a first electrical parameter reference value based on said raw data received from said at least one sensor and generating a series of said first electrical parameter reference values based on periodic measurements of said raw data and (3) means for determining whether an alarm condition exists based on said first electrical parameter reference value;

a plurality of communication lines extending from said detector for receiving and transmitting said series of first electrical parameter reference values from said detector; and a control panel, connected to said plurality of communication lines, including (1) means for receiving said series of said first electrical parameter reference value from said plurality of communication lines; (2) means for calculating a second electrical parameter reference value based on said series of said first electrical parameter reference values and (3) means for determining whether said alarm condition exists based on said second electrical parameter reference value, wherein transmission of said raw data along said plurality of communication lines to said control panel and processing of said raw data by said control panel is minimized.

* * * * *